US005344337A

United States Patent [19]

Ritter

[11] Patent Number: 5,344,337

[45] Date of Patent: Sep. 6, 1994

[54] ELECTRICAL CONNECTOR WITH RUBBER BOOT SEAL

[75] Inventor: Thomas E. Ritter, Katy, Tex.

[73] Assignee: Halliburton Logging Services, Houston, Tex.

[21] Appl. No.: 79,540

[22] Filed: Jun. 21, 1993

Related U.S. Application Data

[63] Continuation of Ser. No. 842,670, Feb. 27, 1992, abandoned.

[51] Int. Cl.[5] ..... H01R 13/52; H01R 13/56

[52] U.S. Cl. ..... 439/447; 439/891

[58] Field of Search ..... 439/271-277, 439/587-589, 604, 445, 447, 891, 879

*Primary Examiner*—Neil Abrams

*Attorney, Agent, or Firm*—Arnold, White & Durkee

[57] ABSTRACT

An electrical feedthrough connector is illustrated for use in down hole sondes and other logging tools exposed to pressures of up to 25,000 psi and temperatures of 500° F. It incorporates an elongate conductive metal pin surrounded by a concentric sleeve of insulative material and on the exterior of that, there is an elongate metal clad sleeve. This defines the structure so that the feedthrough can be mechanically anchored on a bulk head. In addition, at the end exposed to high pressure, the central conductor is totally covered by an elongate insulative sleeve. On the exterior of that, there is an elongate all encompassing resilient boot which extends substantially up the length of cable connected with the feedthrough connector but which is in contact only with surfaces which are insulated from the central conductor. This boot is formed of resilient rubber like material and is capable of deforming. It excludes the intrusion of fluids in the well borehole environment where the device is used.

6 Claims, 1 Drawing Sheet

ELECTRICAL CONNECTOR WITH RUBBER BOOT SEAL

This application is a continuation of application Ser. No. 07/842,670, filed Feb. 27, 1992, and now abandoned.

BACKGROUND OF THE DISCLOSURE

The present disclosure is directed to an electrical connector which extends through a bulk head, and more particularly one which is provided with a protective rubber boot seal there-around on the high pressure side. It is a type of construction particularly useful in downhole logging tools. The circumstances in which this device is used are extremely difficult. Generally speaking, an electrical connector of this sort is intended to be used at elevated pressures and temperatures. It is not uncommon to lower a well tool into a well (both cased or open hole) where the operating pressure at several thousand feet down the well can be as high as 25,000 psi and the ambient temperature can be as high as 500° F. Normally, such logging operations are carried out in the well borehole where the ambient environment is any of a mixture of liquid such as brine, oil based drilling fluids, and produced oil or natural gas. Natural gas typically carries highly reactive chemicals with it including methane, $CO_2$ and $H_2S$. All of these materials form a prevailing atmosphere of reactive chemicals, and they are especially reactive at the elevated pressures and temperatures observed. The highly reactive chemicals in the fluids around such an oil well logging tool pose a serious problem in the construction of electrical feedthroughs.

In one application, this device is a feedthrough which is adapted to be placed in a bulk head where one side is exposed to a hermetically sealed chamber within the tool. The internal pressure may be reduced, perhaps even to atmospheric pressure creating a pressure difference up to 25,000 psi across the bulkhead. The internal chamber may be isolated by the hermetic construction of the case or housing which encloses the components. This case or housing is typically described as a sonde which encloses the requisite components; typically however the logging tool takes on the temperature of the surrounding fluid in the well and will increase in temperature to that prevailing temperature, even as high as 500° F. Moreover, the exposed side of the feedthrough may well be exposed to the fluid which carries the various reactive constituents in it and is almost always conductive. Accordingly, highly corrosive reactions may attack the exposed side of the feedthrough. Just as one example, $H_2S$ in the produced well fluid even in just a few parts per million (perhaps 1 to 10 ppm), provides a basis whereby hydrogen embrittlement may attack the metal case or housing made of steel. Special efforts have to be undertaken to isolate the steel housing from the highly reactive $H_2S$. Some materials which are successfully resistant to $H_2S$ may however succumb to salt water, and especially salt water at such elevated pressures and temperatures. Indeed, the materials which are exposed to the feedthrough represent something of a witches brew in the ability of the materials to attack the surfaces of metals in the logging tool and especially at the feedthrough locations.

The present apparatus is a device having the form of an electrical feedthrough which is particularly effective to exclude the highly reactive fluids in the immediate vicinity of the feedthrough. The present apparatus includes a rubber boot which serves as an external seal to exclude reactive fluid constituents from contact against conductive elements of the feedthrough. Even so, the rubber boot poses a problem. At elevated pressure and temperatures, the rubber boot itself runs the risk of conversion of its resistivity. It is a very resistant material (electrically speaking) which is highly effective at temperatures prevailing at the surface of the well. At the elevated temperatures in a downhole situation, that does not hold true, and i t may become a type of unintended current bleed path from the interior to the exterior and providing current leakage which poses a problem. If the feedthrough is on a high current fitting such as one delivering system power for operation of the equipment within the sonde, the leakage current can be sizable. If a small electrical signal is transmitted through the feedthrough such as a signal in the range of a few millivolts, the leakage may be quite noisy and create problems in the quality of the signal transferred through the electrical connection. That also poses a problem. The present apparatus overcomes these problems by first arranging an externally located rubber boot seal which is incorporated to exclude the external fluids in the surrounding borehole. Moreover, electrical shorting as the rubber boot interacts with the prevailing fluids at the ambient temperature is avoided.

SUMMARY OF THE DISCLOSURE

This disclosure sets forth an electrical connector incorporating a feedthrough for use at a bulk head which is exposed to extremely high pressures and temperatures prevailing in a well borehole which may be as high as 25,000 psi and 500° F. The device particularly features an externally exposed rubber boot which fits over the end of the electrical wire or cable which is being connected by the device. The rubber boot has a long axial bore and flairs out to an enlarged cylindrical size to enable it to fit around a plastic insulator. The plastic insulator then fits around a socket connector on the interior. The socket connector is axially positioned within the boot and the plastic insulator for connection with the wire. More importantly, the rubber boot provides protection yet it does not contact any metal within the interior of the rubber boot so that leakage across the rubber boot when it becomes more conductive at elevated temperatures is suppressed. On the interior of the plastic insulator, there is a central rod which passes through a ceramic housing protected with an external metal shell which enables connection at a bulk head. At the distal end of the equipment, there is an exposed tip for connection as appropriate.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
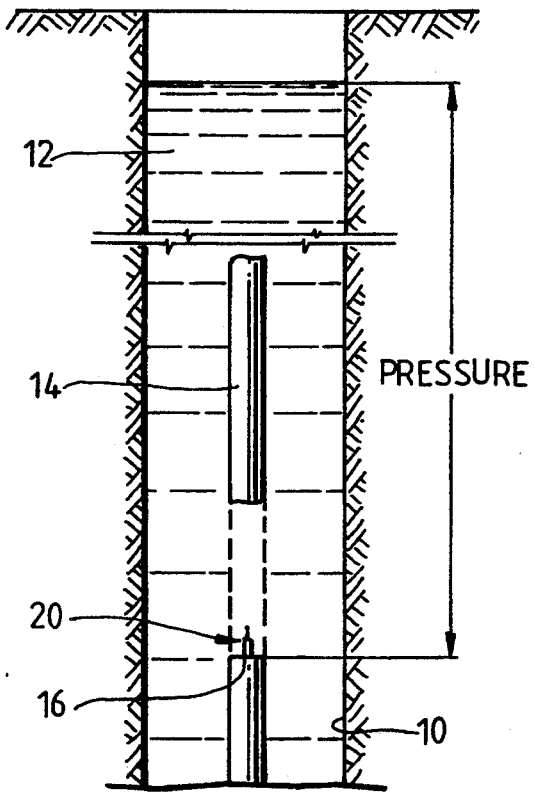
FIG. 1 shows a sonde supported in a deep well borehole with a portion broken away to show a feedthrough connector in accordance with the present disclosure.

In FIG. 1 of the drawings, the numeral 10 identifies a deep well borehole which may be cased or uncased and which is typically filled with a standing column of fluid 12. At some depth, there is a pressure which prevails on a sonde 14. The depth can be quite deep so that the pressure is quite high, even as high as 25,000 psi. At these depths, the temperature can be as high as 500° F. or more. The sonde 14 is shown with a portion broken away and further includes an internal bulk head 16. The bulk head supports a feedthrough constructed in accordance with the present disclosure and identified generally by the numeral 20. It is shown at the bulk head 16. One side of it is mounted so that it is exposed to the ambient pressure within the well. The opposite side of the feedthrough is located in the sonde and may well be at the same pressure, or may inside at some extremely reduced internal pressures such as atmospheric pressure. This typically occurs when the interior of the sonde is sealed on closure at the surface. The sonde 14 is raised and lowered repetitively on a wireline logging cable which extends into the well borehole 10. The sonde, whether raised or lowered, requires connection of the conductive element of the logging cable into the tool through the electrical feedthrough connector 20 of this disclosure to deliver a voltage or current flow across the bulk head 16.

Figure 2:
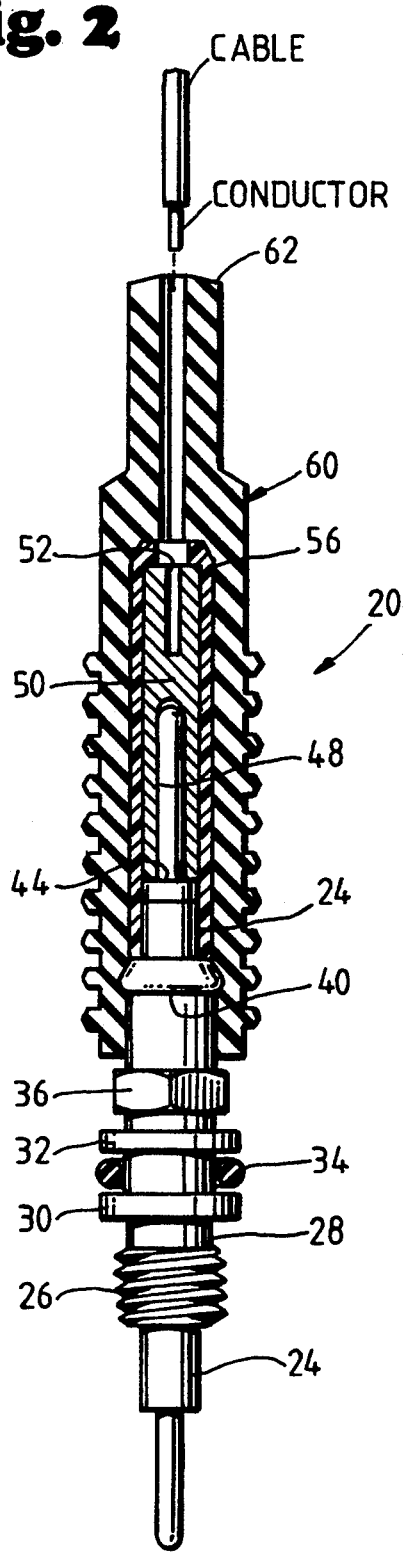
FIG. 2 is a sectional view along the length of a feedthrough connector constructed in accordance with the teachings of the present disclosure.

The feedthrough connector 20 is shown in sectional view in FIG. 2 of the drawings. The drawing has been enlarged and the connector has been removed from the context of its installation in FIG. 1 and is shown in an assembled state. It incorporates a central pin 48 which is an electrical conductor extending through the internal insulator 24 that encases and surrounds the pin terminating at the shoulder 44. The internal insulator is encased in a steel outer body 28 with a suitable threaded metal area 26 which enables threading to cooperative plugs or other fittings within the sonde 14. The metal sleeve 28 on the exterior supports a set of shoulders 30 and 32 which receive a seal ring 34 between for sealing when mounted in the bulk head 16. The seal cooperates with the surrounding bulk head material when positioned in an appropriately drilled hole so that the feedthrough connector 20 can be fixedly attached to the bulk head.

For gripping purposes, the external metal sleeve 28 is provided with a set of flats for a wrench or other hand tool which are shown at 36. The metal sleeve 28 extends upwardly to an enlargement 40 where it terminates.

There is a socket connector body 50 located around this central conductor 48 which extends down against the shoulder 44. The body 50 has a receptacle at 52 to enable a wire to extend into it to make complete electrical connection when crimped or soldered. The socket connector 50 is completely enclosed within and wrapped on the exterior by a insulator sleeve 56. The insulator sleeve 56 can be formed of plastics such as Teflon®, a trademark of the DuPont firm, which sustain shape and integrity even at temperatures above 500° F.

The insulative sleeve 56 provides insulative protection to the socket 52, pin 48 and extended upper end of the insulator 24. The plastic material of the sleeve 56 thus completely surrounds and covers all conductor surfaces so that no portion of the metal socket or pin insulator is exposed on the exterior surface. This sleeve then is completely surrounded by the rubber boot 60. The boot 60 has an extending upper end 62 of sufficient length that surrounds a conductor wire and prevents leakage along the axial passage. It is preferably made to have a very tight grip. Moreover, it is sized so that it fits around all the other components on the interior. The lower end of the boot is made to have a very tight interference fit around the enlargement 40 to exclude liquid entry at the interface on the interior of the rubber boot. The boot must be stretched when it is installed. By referring to it as a boot made of rubber, it is preferably formed of material which is capable of operating at the requisite pressures and temperatures. They can be various specialty grades of Fluoroelastomers and is able to completely prevent liquid entry into the interior of the rubber boot. Nevertheless, the boot, normally an insulator at room temperature, could become in some measure a feedthrough or conductive short which destroys electrical fidelity at elevated temperatures. To this end, the boot itself is in contact with the insulative sleeve on the conductor wire that is centered in the boot, the insulator sleeve 56 on the exterior of the socket connector 50, and the metal sleeve 28 near the enlargement 40. In other words, the rubber boot is completely insulated from contact with the central conductor pin 48, the socket connector 50 and the conductor wire. Therefore, the rubber boot is not able to provide an electrical path for conduction through the boot itself serving as a short from the interior conductor to another metal surface or through the conductive fluid surrounding the boot.

The boot is the key component from the time of installation which protects against electrical shorts or leakage pathways through the equipment. As ambient pressure is raised around the boot, the material of the boot yields and tends to flow. Flow of the boot material does not jeopardize the electrical insulative qualities which have been mentioned above.

The size of the present apparatus can be varied depending on the size of the cable and conductor which is placed in the feedthrough. Other dimensions can be varied including the length of the boot so that the amount of rubber griping the connected cable is varied. As a generalization, the boot is preferably made as long as can be reasonably handled taking into account that excessive length does not really gain that much more in use.

While the foregoing is directed to the preferred embodiment, the scope thereof is determined by the claims which follow:

I claim:

1. For use in a downhole well logging tool, an electrical feedthrough which comprises:

a surrounding rigid body formed of insulative material about a central elongate current carrying metal member having one end extending from said body and constructed for cooperation in a plug and socket connection and having an opposite end adapted to be connected with the proximal end of an electrical cable having a conductor within an insulative cable jacket;

an elongate, conductive metal, cooperative plug and socket electrical connector serially connected between, and fully surrounding said opposite end of said metal member and said proximal end of an electrical cable conductor;

an insulative sleeve fully surrounding said plug and socket electrical connector;

a metal sleeve surrounding said insulative rigid body, said metal sleeve including an enlargement; and an elongate removable resilient boot on the exterior completely surrounding that portion of the feed-through exposed to high pressure and high temperature wherein said removable boot has an elongate central axial passage termination at a first end thereof to enable an electrical cable to be extended therethrough so that said removable resilient boot is completely insulated from contact with said central elongate current carrying metal member, said plug and socket electrical connector and said electrical cable conductor wire, said boot further including a second end which contacts said enlargement wherein said enlargement functions as a shoulder holding said boot on said metal sleeve.

2. The apparatus of claim 1 wherein said insulative sleeve is fully encircled and enclosed by said boot.

3. The apparatus of claim 2 wherein said insulative sleeve includes a lower end telescoped around said rigid body.

4. The apparatus of claim 3 wherein said insulative sleeve is an elongate cylindrical sleeve.

5. The apparatus of claim 4 wherein said plug and socket connector has the form of an elongate hollow metal cylinder with end located socket holes.

6. The apparatus of claim 4 wherein said boot has a central portion at said first end sized to snugly fit around said electrical cable.

* * * * *